US005415076A

United States Patent [19]

Krone et al.

[11] Patent Number: 5,415,076

[45] Date of Patent: May 16, 1995

[54] HYDRAULIC SYSTEM HAVING A COMBINED METER-OUT AND REGENERATION VALVE ASSEMBLY

[75] Inventors: John J. Krone, Dunlap, Ill.; Kazunori Yoshino, Kobe, Japan

[73] Assignee: Caterpillar Inc., Peoria, Ill.

[21] Appl. No.: 228,768

[22] Filed: Apr. 18, 1994

[51] Int. Cl.[6] ..... F15B 11/08; F15B 13/04

[52] U.S. Cl. ..... 91/421; 91/436; 91/439; 91/440

[58] Field of Search ..... 91/459, 421, 416, 436, 91/437, 439, 440, 445; 60/494, 403

[56] References Cited

U.S. PATENT DOCUMENTS

| | | | |
|---|---|---|---|
| 3,685,531 | 8/1972 | Byford | 91/94 X |
| 4,028,889 | 6/1977 | Budzich | 60/420 |
| 4,040,438 | 8/1977 | Wike | 91/421 X |
| 4,337,689 | 7/1982 | Heusler | 91/437 X |
| 4,685,295 | 8/1987 | Christiansen et al. | 91/421 X |
| 4,819,541 | 4/1989 | Pitsch et al. | 91/421 X |
| 4,972,761 | 11/1990 | Thomsen | 91/445 X |
| 5,218,897 | 6/1993 | Shirai et al. | 91/436 |
| 5,220,862 | 6/1993 | Schexnayder | 91/436 |
| 5,287,794 | 2/1994 | Anderson | 91/436 |

*Primary Examiner*—Edward K. Look
*Assistant Examiner*—Hoang Nguyen
*Attorney, Agent, or Firm*—John W. Grant

[57] ABSTRACT

Fluid regeneration circuits are useful for filling expanding sides of a hydraulic cylinder with fluid being exhausted from the other side. The currently available circuits pass the excess fluid not needed for filling the expanded side of the cylinder through the directional control valve to the tank such that the directional control valve must be actuated for the regeneration valve assembly to function. A combined meter-out and regeneration valve assembly of the present invention is used in a hydraulic system having a directional control valve for metering in pump to cylinder fluid flow and includes a meter-out valve to meter-out cylinder to tank fluid flow from a head end actuating chamber. The fluid passing through the meter-out valve passes through an exhaust conduit to a tank bypassing the directional control valve. This permits the meter-out valve to be used independently of the directional control valve to retract a hydraulic cylinder. A flow regeneration valve and a pressure boost valve are used in combination with the meter-out valve for providing flow regeneration from the head end chamber to a rod end chamber when fluid pressure in the head end chamber is less than the pressure level of fluid in a passage as determined by a spring of the pressure boost valve.

9 Claims, 1 Drawing Sheet

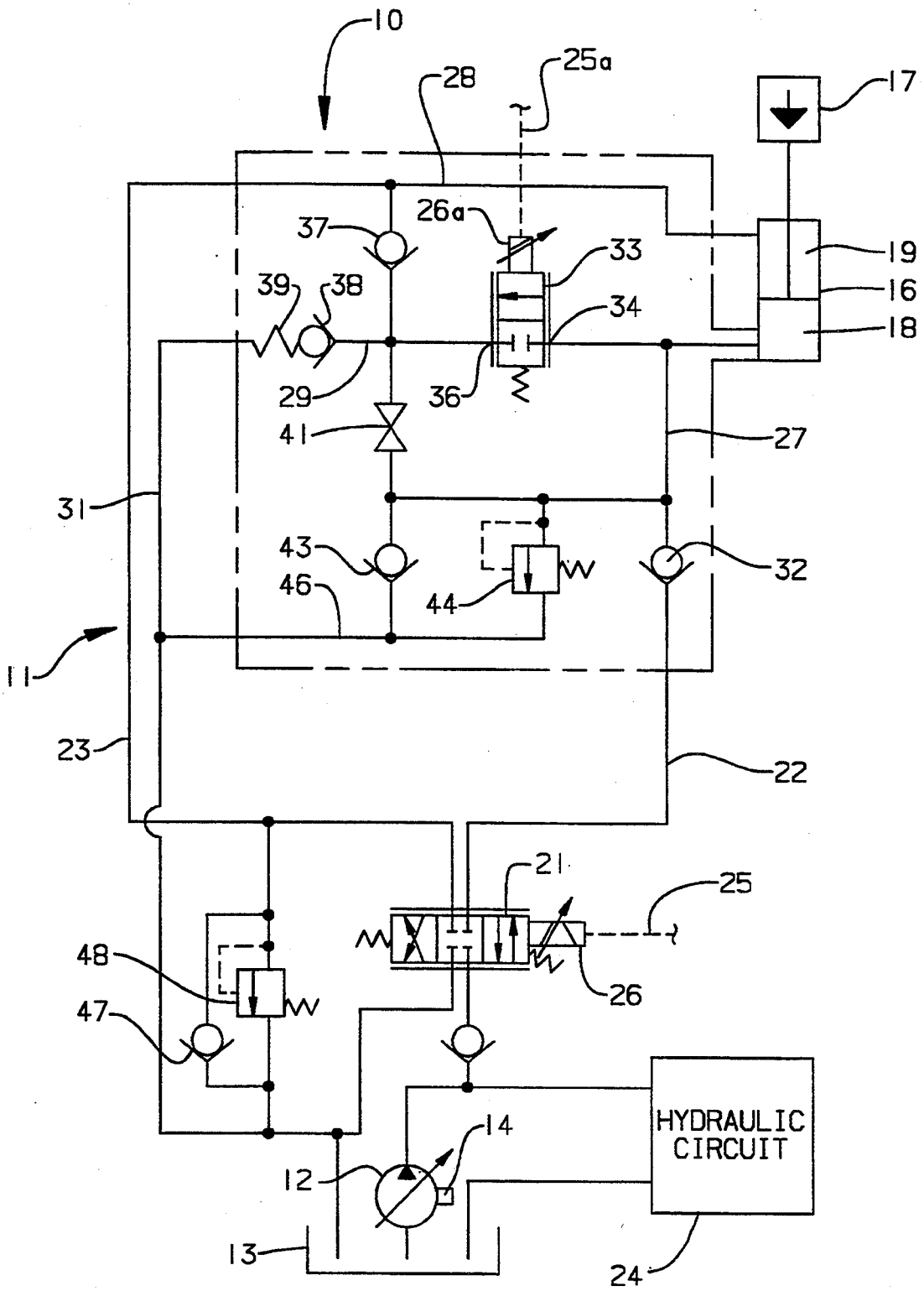
10
28
25a
17
26a
37
33
19
39
38
34
16
18
29
36
41
27
31
43
32
46
44
11
23
22
21
25
48
26
47
HYDRAULIC CIRCUIT
14
12
13
24

HYDRAULIC SYSTEM HAVING A COMBINED METER-OUT AND REGENERATION VALVE ASSEMBLY

TECHNICAL FIELD

This invention relates to a hydraulic control system and more particularly to a hybrid system having a combined meter-out and regeneration valve assembly separated from the main directional control valve and associated with one actuation chamber of a hydraulic actuator.

BACKGROUND ART

Some hydraulic control systems employ a regeneration circuit to fill the expanding side of a hydraulic actuator with fluid exhausted from the contracting side of the actuator. Thus, less fluid is required from the system pump thereby allowing the fluid from the system pump to be used for other work circuits of the system. One such regeneration circuit is disclosed in U.S. Pat. No. 4,028,889.

One of the problems encountered with such regeneration circuit is that some of the components causing regeneration have heretofore been incorporated within the directional control valve while other components are disposed in the return line between the directional control valve and the tank. Locating the regeneration components at such locations drastically reduces the efficiency of the regeneration circuit. For example, the fluid exhausted from the actuator must travel the full length of the actuator lines between the actuator and the directional control valve, pass through the directional control valve in a first direction and then in a reverse direction, and then travel through the full length of the other actuator lines to the expanding side of the actuator. The shape of the passages through the valve body and the flow control element therein restricts fluid flow therethrough thereby generating a pressure drop in the exhausted fluid. An additional pressure drop is generated due to the fluid having to travel through the actuator lines, which on some vehicles can exceed 7 or 8 meters. The combined affect of the higher pressure drops necessitates the pressure setting of the regeneration circuits to be at a higher level to adequately provide regeneration. U.S. Pat. No. 5,220,862 solves this problem somewhat by mounting the components of the regeneration circuit directly to or in close proximity to the hydraulic actuator to minimize line losses or pressure drops associated with having the fluid travel through long lines or conduits connecting the directional control valve to the actuator. Mounting the regeneration components at that location lets the exhausted fluid go directly to the expanding side of the actuators and bypasses the directional control valve which would generate an additional pressure drop in the regeneration fluid.

One of the disadvantages with such circuit is that the regeneration circuit is primarily used for diverting fluid exhausted from the head end to the rod end of the actuator. Since the volume of fluid needed to fill the rod end is less than the volume of fluid exhausted from the head end, the main directional control valve must be moved to an operating position so that excess fluid exhausted from the head end can pass therethrough to the tank. However, since the timing of the metering slots of most directional control valves are typically designed to provide acceptable operation under pump-to-cylinder meter in operating conditions, fine control of retracting the actuator is difficult particularly if the actuator is supporting a heavy load.

In view of the above, it would be desirable to have a regeneration function combined with a meter-out function in such a way that the meter-out and regeneration function can operate in combination with the main directional control valve for normal retraction of the actuator or can be operated independently of the directional control valve for lowering a gravity load supported by the actuator.

The present invention is directed to overcoming one or more of the problems as set forth above.

DISCLOSURE OF THE INVENTION

In one aspect of the present invention a combined meter-out and fluid regeneration valve assembly is provided for a hydraulic system having a double acting hydraulic cylinder which has first and second actuating chambers with the first actuating chamber being subjected to load induced pressure and first and second conduits connected to the first and second actuating chambers respectively. A load check valve is disposed in the first conduit to permit fluid flow therethrough in a first direction toward the first chamber and blocks reverse fluid flow therethrough. A remotely controlled meter-out valve has an inlet and an outlet with the inlet being connected to the first conduit between the load check valve and the first chamber. The meter-out valve has a closed position blocking the inlet from the outlet and a variable metering position establishing variable communication between the inlet and the outlet. A third conduit is connected to the outlet of the meter-out valve. A check valve is disposed between the second and third conduits and is oriented to permit substantially unrestricted fluid flow from the third conduit to the second conduit when the fluid pressure in the second conduit is less than the fluid pressure in the third conduit.

BRIEF DESCRIPTION OF THE DRAWINGS

The sole figure is a schematic illustration of an embodiment of the present invention.

BEST MODE FOR CARRYING OUT THE INVENTION

A valve assembly 10 which provides a meter-out function and a flow regeneration function is shown as an integral part of a hydraulic system 11. The hydraulic system includes a variable displacement pump 12 connected to a tank 13 and has a displacement controller 14 for controlling the displacement of the pump proportional to a control signal suitably directed thereto in a conventional manner. The hydraulic system also includes a double acting hydraulic cylinder 16 supporting a load 17 and having head end and rod end actuating chambers 18,19, respectively, a directional control valve 21 connected to the pump 12 and the tank 13, a pair of cylinder conduits 22,23 connecting the directional control valve with the head end actuating chamber 18 and the rod end actuating chamber 19, respectively, and one or more additional hydraulic circuits 24 connected to the pump and tank.

The directional control valve 21 is an electrohydraulic control valve and is illustrated as a solenoid operated proportional valve having an electrical line 25 connected to a solenoid actuator 26. However, the invention is not limited to this specific form of valve and may be formed as a pilot operated valve actuated by a pilot signal generated either by a solenoid operated proportional valve or a manually operated pilot valve. The invention is also not limited to the three-position, four-way, closed center valve shown but may be of any suitable type either closed center or open center so long as the cylinder conduits 22/23 are blocked from each other and from the pump and tank at the neutral position shown.

The valve assembly 10 includes a passage 27 which forms a portion of the conduit 22, a passage 28 which forms a portion of the conduit 23 and a passage 29 which forms a portion of an exhaust conduit 31 connected to the tank 13. A load check valve 32 is disposed in the passage 27 to permit fluid flow therethrough in a first direction toward the chamber 18 and blocks reverse fluid flow therethrough. An electrohydraulic meter-out valve 33 is positioned within the valve assembly and has an inlet 34 connected to the passage 27 and an outlet 36 connected to the passage 29. The meter-out valve has a closed position blocking the inlet from the outlet and a variable metering position establishing variable communication between the inlet and the outlet. The meter-out valve is illustrated as a solenoid operated proportional valve having an electrical line 25*a* connected to a solenoid actuator 26*a*.

A flow regeneration check valve 37 is disposed between the passages 28,29 and is oriented to permit substantially unrestricted fluid flow from the passage 29 to the passage 28 when the fluid pressure in the passage 28 is less than the pressure in the passage 29. A pressure boost valve 38 is disposed within the passage 29 and is oriented to block fluid flow from the exhaust conduit 31 to the inlet 34. The boost valve is biased to the closed position by a spring 39 to block fluid flow from the inlet to the exhaust conduit 31 until the fluid pressure in the inlet exceeds a predetermined level. A manual on/off valve 41 is suitably disposed between the passages 27 and 29. The valve assembly 10 also includes a makeup valve 43 and a relief valve 44 connected in parallel between the passage 27 and another passage 46 which is connected to the exhaust conduit 31.

Another makeup valve 47 and another relief valve 48 are connected in parallel between the conduits 23 and 31.

INDUSTRIAL APPLICABILITY

In operation, the hydraulic cylinder 16 is extended by directing an appropriate electrical signal through the line 25 to the solenoid actuator for moving the directional control valve 21 leftwardly to an operating position to meter in pump-to-cylinder flow from the pump to the actuating chamber 18 by way of the conduit 22. The pressurized fluid in the conduit 22 unseats the load check valve 32 and passes into the actuating chamber 18. The meter-out valve 33 remains in the closed position so that the pressurized fluid entering the chamber 18 extends the hydraulic cylinder. The fluid in the actuating chamber 19 is exhausted through the conduit 23 and is returned to the tank 13 through the directional control valve 21.

This system provides several methods of retracting the hydraulic cylinder 16 with those methods depending somewhat on whether the load is aiding cylinder retraction or opposing cylinder retraction and the magnitude of the load when the load is aiding cylinder retraction. A first method of retracting the hydraulic cylinder when the load is aiding retraction, includes moving the directional control valve 21 rightwardly to meter in pressurized fluid from the pump to the actuating chamber 19 while simultaneously moving the meter-out valve downwardly to a meter-out position establishing variable communication between the inlet 34 and the outlet 36 and, thus, between the actuating chamber 18 and the passage 29. Since the load check valve 32 blocks reverse flow through the conduit 22, the fluid exhausted from the actuating chamber 18 passes through the open meter-out valve into the passage 29. The fluid entering the passage 29 either passes through the pressure boost valve 38 and returns to the tank or the flow is split with a portion passing through the pressure boost valve to the tank and a portion passing through the flow regeneration valve 37 where it is combined with the pump flow to fill the expanding actuating chamber 19. Since the pressure boost valve 38 opens only when the fluid pressure in the passage 29 exceeds a predetermined pressure level as determined by the spring 39, the flow path of the exhausted fluid is determined by the relative pressures in the passages 28 and 29.

For example, if the fluid pressure in the passage 28 is greater than the predetermined pressure level, the flow regeneration valve is held in the closed position so that all exhausted fluid passes through the pressure boost valve to the tank. This condition exists when a positive pressure above the predetermined pressure level is generated in the actuating chamber 19 to cause cylinder retraction. However, when the fluid pressure in the passage 28 is less than the predetermined pressure level, then the flow regeneration valve opens to allow a portion of the exhausted fluid to combine with the pump flow directed to the rod end chamber 19. This condition can exist in an overrunning load situation in which the load tends to retract the hydraulic cylinder faster than the incoming fluid from the pump can fill the actuating chamber 19.

A second method permits the hydraulic cylinder to be retracted by gravity load without the use of fluid from the pump. This method includes moving the meter-out valve 33 to an open position while maintaining the directional control valve 21 in the flow blocking position shown in the drawing. By opening only the meter-out valve, the fluid exhausted from the head end actuating chamber 18 initially entering the passage 29 passes through the flow regeneration valve 37 to fill the expanding rod end actuating chamber 18. However, since the volume of fluid exhausted from the head end actuating chamber is greater than the volume of fluid required to fill the rod end actuating chamber, the fluid pressure in the passage 29 quickly exceeds the predetermined pressure level so that the pressure boost valve opens to allow a portion of the exhausted fluid to return to the tank.

The manual on/off valve 41 is closed during normal operation but can be utilized for lowering the load 17 should an electrical failure occur. Manually opening the on/off valve 41 communicates the actuating chamber 18 with the passage 29 so that the exhausted fluid passes through the flow regeneration valve 37 and the pressure boost valve 38 essentially as described above when only the meter-out valve is open.

In view of the above, it is readily apparent that the structure of the present invention provides an improved hydraulic system having a combined meter-out and regeneration valve assembly. The components of the meter-out and regeneration valve assembly can be mounted directly to or in close proximity to the hydraulic cylinder providing a more efficient fluid regeneration flow path with less pressure losses. Moreover, the meter-out valve can be operated independently of the meter in directional control valve thereby allowing a load connected to the hydraulic cylinder to be lowered by gravity without cavitating the rod end actuating chamber. Another advantage is that the meter-out valve can be used to precisely control the rate of cylinder retraction when the load acting on the hydraulic cylinder aids cylinder retraction or can be moved to a wide open position to reduce throttling losses when the hydraulic cylinder is being retracted by fluid pressure directed to the rod end actuating chamber.

Other aspects, objects and advantages of this invention can be obtained from a study of the drawings, the disclosure and the appended claims.

We claim:

1. A combined meter-out and fluid regeneration valve assembly for a hydraulic system having a double acting hydraulic cylinder which has first and second actuating chambers with the first actuating chamber being subjected to load induced pressure, and first and second conduits connected to the first and second actuating chambers respectively, comprising:

a load check valve disposed in the first conduit to permit fluid flow therethrough in a first direction toward the first actuating chamber and blocks reverse fluid flow therethrough;

a remotely controlled meter-out valve having an inlet and an outlet with the inlet being connected to the first conduit between the load check valve and the first chamber, the meter-out valve having a closed position blocking the inlet from the outlet and a variable metering open position establishing variable communication between the inlet and the outlet;

a passage connected to the outlet of the meter-out valve; and a flow regeneration valve disposed between the passage and the second conduit and being oriented to permit substantially unrestricted fluid flow from the passage to the second conduit when the fluid pressure in the second conduit is less than the fluid pressure in the passage.

2. The combined meter-out and regeneration valve assembly of claim 1 including an exhaust conduit and a pressure boost valve disposed between the passage and the exhaust conduit and oriented to block fluid flow from the exhaust conduit to the passage, the pressure boost valve being biased to the closed position blocking fluid flow from the passage to the exhaust conduit until the fluid pressure in the passage exceeds a predetermined level.

3. The combined meter-out and regeneration valve assembly of claim 2 wherein the first actuating chamber is a head end actuating chamber.

4. The combined meter-out and regeneration valve assembly of claim 3 wherein the hydraulic system includes a pump, a tank and a directional control valve connected to the pump, the tank and the first and second conduits.

5. The combined meter-out and regeneration valve assembly of claim 1 including a make up valve disposed between the exhaust conduit and the first conduit upstream of the load check valve.

6. The combined meter-out and regeneration valve assembly of claim 5 including a manually operated shut off valve disposed between the first conduit and the passage substantially in parallel to the meter-out valve.

7. The combined meter-out and regeneration valve assembly of claim 6 wherein the meter-out valve is an electrically actuated valve.

8. A hydraulic system having a pump, a tank, a double-acting hydraulic cylinder having first and second chambers with the first chamber being subjected to load generated pressure, first and second conduits, a directional control valve connected to the pump, the tank and to the first and second conduits for controlling fluid flow from the pump to the conduits and between the conduits and the tank; comprising an exhaust conduit in continuous communication with the tank; and a valve assembly mounted to the hydraulic cylinder and having a first passage communicating the first conduit with the first actuating chamber, a second passage communicating the second conduit with the second actuating chamber, a load check valve disposed in the first passage to permit fluid flow therethrough in a first direction toward the first chamber and to block reverse fluid flow therethrough, a third passage in communication with the exhaust conduit, and a remotely controlled meter-out valve having a closed position blocking the first passage from the third passage and a variable metering position establishing variable communication between the first passage and the third passage, the third passage and the exhaust conduit defining a flow path from the meter-out valve to the tank bypassing the directional control valve.

9. The hydraulic system of claim 8 wherein the valve assembly includes a flow regeneration valve disposed between the third passage and the second passage to permit substantially unrestricted fluid flow from the third passage to the second passage when the fluid pressure in the second passage is less than the fluid pressure in the third passage, and a pressure boost valve disposed between the third passage and the exhaust conduit and oriented to block fluid flow from the exhaust conduit to the third passage, the pressure boost valve being biased to the closed position blocking fluid flow from the third passage to the exhaust conduit until the fluid pressure in the third passage exceeds a predetermined level.

* * * * *